US007695111B2

(12) United States Patent
Kitani

(10) Patent No.: US 7,695,111 B2
(45) Date of Patent: Apr. 13, 2010

(54) LIQUID DISCHARGE HEAD AND MANUFACTURING METHOD THEREFOR

(75) Inventor: Koji Kitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 549 days.

(21) Appl. No.: 11/675,209

(22) Filed: Feb. 15, 2007

(65) Prior Publication Data

US 2007/0211117 A1 Sep. 13, 2007

(30) Foreign Application Priority Data

Mar. 8, 2006 (JP) ..... 2006-062000

(51) Int. Cl.
*B41J 2/05* (2006.01)

(52) U.S. Cl. ..... 347/61; 347/63

(58) Field of Classification Search ..... 347/59, 347/61, 63

See application file for complete search history.

(56) References Cited

U.S. PATENT DOCUMENTS

| | | | | |
|---|---|---|---|---|
| 5,980,026 | A | 11/1999 | Imamura et al. | |
| 6,390,606 | B1 | 5/2002 | Terui et al. | |
| 6,676,241 | B2 | 1/2004 | Yabe | |
| 6,945,635 | B2 * | 9/2005 | Kubota et al. | 347/63 |
| 6,953,530 | B2 | 10/2005 | Kanri | |
| 7,165,830 | B2 * | 1/2007 | Miller, Jr. | 347/64 |

FOREIGN PATENT DOCUMENTS

| | | |
|---|---|---|
| JP | 5-96734 | 4/1993 |
| JP | 5-301345 | 11/1993 |
| JP | 9-57985 | 3/1997 |
| JP | 11-348290 | 12/1999 |
| JP | 2002-248771 | 9/2002 |
| JP | 2002-326361 | 11/2002 |

* cited by examiner

*Primary Examiner*—An H Do
(74) *Attorney, Agent, or Firm*—Fitzpatrick, Cella, Harper & Scinto

(57) ABSTRACT

A liquid discharge head includes a substrate, on which are formed energy generating members for generating energy to be used for the discharge of a liquid through a discharge port, and a precious metal protective layer for protecting the energy generating members, an inorganic adhesive layer formed of at least one material selected from titanium, titanium nitride, tantalum nitride and chromium nitride, the inorganic adhesive layer being closely adhered to the precious metal protective layer, an organic adhesive layer made of an organic material, and a flow path formation member, serving as a wall of a flow path communicating with the discharge port. The substrate, the inorganic adhesive layer, the adhesive layer and the flow path formation member are bonded to the substrate in this order.

9 Claims, 4 Drawing Sheets

LIQUID DISCHARGE HEAD AND MANUFACTURING METHOD THEREFOR

BACKGROUND OF THE INVENTION

1. Field of the Invention

The present invention relates to a liquid discharge head mounted on a liquid discharge apparatus and a manufacturing method therefor.

2. Description of the Related Art

A liquid discharge apparatus, such as an ink jet printer, is a system wherein ink is discharged when bubbling is produced by thermal energy generated by an electrothermal transducing element, and can form and record high definition images at high speed. A common configuration used for an ink jet recording head (liquid discharge head) includes: multiple discharge ports, and flow paths that communicate with the discharge ports; and a plurality of electrothermal transducing elements that generate the thermal energy that is used for the discharge of ink. Each of the electrothermal transducing elements includes a heat resistor, and an electrode for supplying power to the heat resistor, that provides insulation between the electrothermal transducing elements. The ends of the individual flow paths on the side opposite the discharge ports communicate with a common liquid chamber, to which ink from an ink tank, which serves as an ink reservoir, is supplied and retained. The ink supplied to the common liquid chamber is introduced to the flow paths, and forms and maintains a meniscus near each of the discharge ports. In this state, when the electrothermal transducing elements are selectively driven, ink on a thermal acting face is rapidly boiled using the thermal energy that is generated, and ink is discharged by pressure associated with the status change.

In the ink discharge process, due to the heating of the heating resistor, the thermal acting portion of the head is exposed at a high temperature, and as the ink bubbles or shrinks, compositely sustains cavitation shock and a chemical reaction. Therefore, a second protective layer is deposited on the thermal action portion to protect the electrothermal transducing elements from cavitation shock and a chemical reaction due to ink. If the second protective layer is damaged or melted by cavitation shock or a chemical reaction, and the first protective layer is exposed to ink, the ink would soon contact the electrothermal transducing elements, so that the electrothermal transducing elements could be disconnected and lose the function of bubbling elements. Thus, the durability of the second protective element is used as one parameter to control the durability of the ink jet recording head.

It is known that, as ink bubbling is performed, the temperature on the surface of the second protective layer rises to around 700° C., for example. Thus, layer characteristics that are superior to heat resistance, mechanical properties, chemical stability, oxidation resistance and alkali resistance are requested for the second protective layer that contacts ink. An example material conventionally proposed for the second protective layer is a precious metal, a high boiling transition metal or an alloy of them, a nitride, a boride, a silside or a carbide of these metals, an amorphous silicon or an amorphous alloy.

Above all, a precious metal is chemically stable, and can cope with ink that is improved on in the future, e.g., ink that is improved on to prevent bleeding (smearing between ink of different colors), or to increase color development or water repellency in consonance with a high image quality. There is a case wherein, when ink is employed that contains, for example, divalent metallic salt, such as Ca (calcium) or Mg (magnesium), or an element for forming a chelate complex, the second protective layer is easily corroded due to thermal reaction with the ink. A second protective layer formed of precious metal is expected to be especially effective for ink that provides such a chemical reaction.

When a precious metal is employed as the second protective layer for an ink jet recording head, the deposition of an adhesive layer made, for example, of titanium or chromium, between the first and second protective layers, is proposed in Japanese Patent Application Laid-Open No. H05-301345. Further, as proposed in Japanese Patent Application Laid-Open No. H05-096734, in order to securely fix a flow path formation member made of an organic material to the second protective layer of the ink jet recording material, oxidization, or a coupling process, is performed for the surface of the second protective layer to increase adhesion.

Additionally, to cope with an increase in accuracy and density, the arrangement disclosed in Japanese Patent Application Laid-Open No. H09-057985 has become popular, i.e., a ceiling portion that includes flow paths and discharge ports is formed by spin coating or the patterning of a resin. According to this arrangement, as described in Japanese Patent Application Laid-Open No. H11-348290, the adhesion of the flow path formation member to the substrate is a problem. Thus, an adhesive resin layer made of a polyether amide resin is arranged between the flow path formation member and the substrate.

As additional proposals, in Japanese Patent Application Laid-Open No. 2002-248771 (U.S. Pat. No. 6,676,241), an adhesive layer is deposited in an area, larger than a bonded face, where stress is concentrated, and in Japanese Patent Application Laid-Open No. 2002-326361 (U.S. Pat. No. 6,953,530), tiny pits are formed in the adhesive portion of a substrate, and anchor effects that increase the adhesive force are thus obtained.

FIGS. 7 and 8 are a partial plan view and a partial cross-sectional view of the arrangement of an ink jet recording head disclosed in Japanese Patent Application Laid-Open No. 2002-248771. For this ink jet recording head, multiple flow path walls 113 and a ceiling portion, in which discharge ports 111 are formed, are provided by employing a flow path formation element 110 made of a resin. The discharge ports 111 are open, opposite each other, above multiple heating resistor layers 102 deposited on the substrate 101. The multiple flow path walls 113 are shaped like the teeth of a comb, and form flow paths for introducing ink, supplied by an ink flow path 112, to the individual electrothermal transducing elements. At the entrance of each flow path, two pillars 114 are located at a predetermined interval and extended perpendicularly in order to prevent dust from entering the flow path.

The flow path formation member 110 is bonded to the substrate 101 by an adhesive resin layer 108 made of a polyether amide resin. That is, the adhesive resin layer 108 is formed between the flow path formation member 110 and the substrate 101.

However, the present inventor found through study that when the second protective layer is formed of a precious metal, adhesion should be promoted with an organic material member that is overlaid.

SUMMARY OF THE INVENTION

While taking into account the problems of the related art, the objective of the present invention is to provide a very durable liquid discharge head, for which adhesion between members that form the liquid discharge head is promoted.

According to the present invention, a liquid discharge head comprises: a substrate, on which are formed energy generating means for generating energy to be used for the discharge of a liquid through a discharge port, and a precious metal protective layer for protecting the energy generating means; an inorganic adhesive layer formed of at least one material selected from titanium, titanium nitride, tantalum nitride and chromium nitride, said inorganic adhesive layer being closely adhered to the precious metal protective layer; an organic adhesive layer made of an organic material; and a flow path formation member, serving as a wall of a flow path communicated with the discharge port, wherein the substrate, the inorganic adhesive layer, the adhesive layer and the flow path formation member are bonded to the substrate in the this order.

Since an adhesive layer is made of at least one material selected from among titanium, titanium nitride, tantalum nitride and chromium nitride, and is deposited between the organic material member and the precious metal protective member, the durability of the liquid discharge head can be increased. Thus, peeling of the members of the liquid discharge head and deterioration, due to the action of ink, of the durability of the precious metal protective layer can be prevented. As a result, the liquid discharge head can be operated for an extended period of time, satisfactorily and stably.

Further, since, at the initial driving time, the second adhesive layer is melted and removed from the heating portion of the electrothermal transducing element, dust can be removed from the second protective layer during the manufacturing process of the liquid discharge head. Thus, the discharge function can also be stabilized. Furthermore, since patterning for the second adhesive layer is not required, the manufacture of a liquid discharge head is simplified.

Further features of the present invention will become apparent from the following description of exemplary embodiments with reference to the attached drawings.

DESCRIPTION OF THE EMBODIMENTS

Exemplary embodiments of the present invention will now be described while referring to the accompanying drawings.

Figure 1:
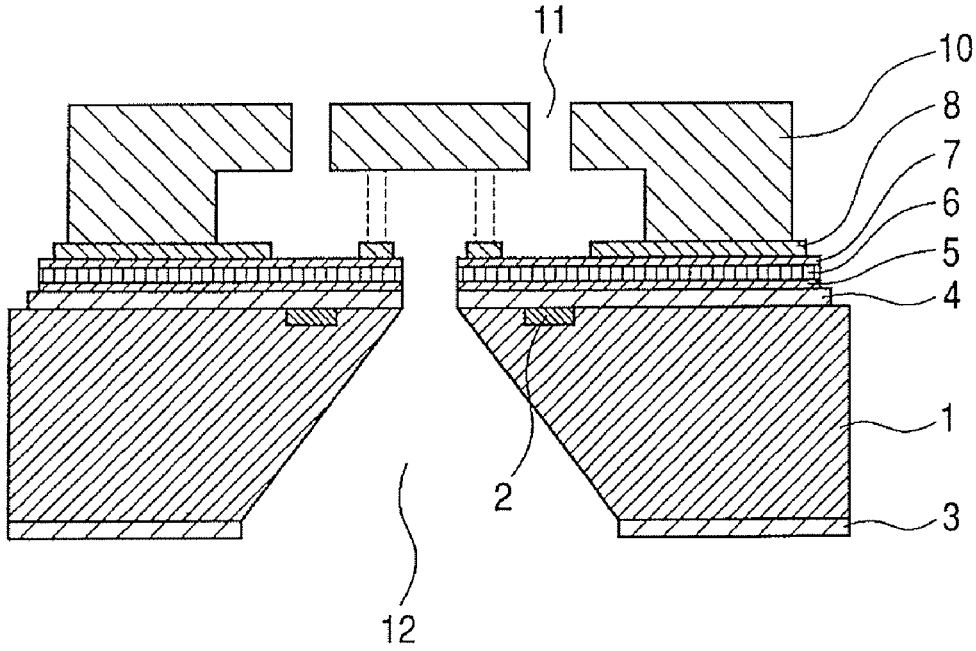
FIG. 1 is a schematic cross-sectional view of a liquid discharge head according to one embodiment of the present invention.

As shown in FIG. 1, an energy generating means (electrothermal transducing element), which is a heating resistor layer 2, is formed on the obverse face of a substrate 1, and a mask 3 is bonded to the reverse face of the substrate 1. The heating resistor layer 2 generates energy to be used for the discharge of liquid from discharge ports. A first protective layer 4, which is an insulating protective film, is deposited on the obverse face of the substrate 1, and a second protective layer 6, which is a precious metal layer, is overlaid by using a first adhesive layer (also called "an additional adhesive layer") 5 made of an inorganic material. A second adhesive layer (also called an inorganic adhesive layer) 7 is deposited on the second protective layer 6.

A flow path formation member 10, to which an adhesive resin layer (also called an "organic adhesive layer") 8 made of an organic material is bonded, includes a ceiling portion in which are formed discharge ports 11 that communicate with flow paths. The flow path formation member 10 is bonded, by using the adhesive resin layer 8, to the second adhesive layer 7 on the substrate 1.

The present inventor studied the materials and the thicknesses of the first adhesive layer, located between the first and second protective layers, and the second adhesive layer, located between the second protective layer and the adhesive resin layer, and found that when titanium was employed as an adhesive layer, high adhesion was obtained and no scratches through the operations were produced when shipped.

More specifically, first, as a preliminary experiment, adhesive layers of the individual materials were deposited between the first and the second protective layers. Then, the adhesive force provided by the materials was compared by conducting a peeling test to determine which material was the superior adhesive material.

Silicon nitride was selected for the first protective layer, and iridium (the name of a precious metal element) was selected for the second protective layer. And titanium (an element name), chromium (an element name) and tantalum (an element name) were selected for the first adhesive layer, by employing, as a reference, the fact that these elements are used as underlayer adhesive metals for the deposition of a precious metal.

A method for fabricating a test piece and a method for conducting a peeling test will now be described.

A six inch Si wafer was prepared, and a 1 μm silicon nitride layer was deposited using a low-temperature plasma CVD. Following this, as an adhesive layer, a 20 nm titanium layer was deposited, using sputtering, and while the substrate was heated to 300° C., sputtering was again used to form a 500 nm iridium layer.

For two additional wafers, chromium and tantalum adhesive layers were formed in the same manner as the titanium layer, and for another wafer, to be used as a reference sample, an adhesive layer was not formed. Thus, four wafers were manufactured in total.

Multiple predetermined cross-cut patterns of 100 cells were formed on the wafers, which were then immersed in ink consisting of ethylene glycol/urea/isopropyl alcohol/black die/water=5/3/2/3/87 parts. Thereafter, a pressure cooker (PCT) test (120° C., 2 air pressure, 50 Hr) was conducted, and before and after the PCT test, a peeling test was performed for the cross-cut patterns, using tape. Then, the results shown in Table 1 were obtained.

TABLE 1

| Adhesive layer | PCT test | |
|---|---|---|
| material | Before | After |
| No material | C | D |
| Ti | A | A |
| Cr | B | B |
| Ta | A | A |
| Titanium nitride | A | A |

TABLE 1-continued

| Adhesive layer material | PCT test Before | After |
|---|---|---|
| Tantalum nitride | A | A |
| Chromium nitride | A | A |

The symbols in Table 1 represent peeling rates: A represents 0%, B represents 1 to 10%, C represents 11 to 50%, and D represents 51% or higher. The peeling of titanium and tantalum did not occur before or after the PCT test, and through this test it was found that titanium and tantalum are superior when used as adhesive layers between the first and second protective layers.

Sequentially, thereafter, adhesive layers composed of different materials were deposited between the second protective layer and the adhesive resin layer made of polyether amide, and their adhesive qualities were compared by conducting a peeling test to determine which was the superior adhesive material. As adhesive layers, not only were titanium, chromium and tantalum examined as adhesive layers, but also nitrides of them, because a material relative to which adhesion was to be increased was not a metal.

A method for fabricating a test piece and a method for conducting a peeling test will now be described.

A six inch Si wafer was prepared, and a silicon nitride layer of 1 μm was deposited thereon by using low-temperature plasma CVD. Then, a titanium layer of 20 nm was deposited, using sputtering, and while the substrate was heated to 300° C., an iridium layer of 500 nm was formed, using sputtering, and a titanium layer of 20 nm was overlaid, using sputtering, as a second adhesive layer. Following this, polyether amide resin HIMAL1200 (product name), produced by Hitachi Chemical Co., Ltd., was applied to the second adhesive layer using a spinner, and the resultant substrate was baked at 100° C. for thirty minutes and then at 250° C. for one hour. In this manner, the 2.0 μm test piece was obtained.

For two more wafers, chromium and tantalum adhesive layers were formed in the same manner as the titanium layer, and for three more wafers, titanium nitride, chromium nitride and tantalum nitride adhesive layers were deposited, using reactive sputtering for introducing nitrogen. While for a wafer to be used as a reference sample, an adhesive layer was not formed. Thus, six wafers were fabricated in total.

Multiple predetermined cross-cut patterns of 100 cells were formed on the wafers, which were then immersed in ink consisting of ethylene glycol/urea/isopropyl alcohol/black die/water=5/3/2/3/87 parts. Thereafter, the pressure cooker (PCT) test (120° C., 2 air pressure, 50 Hr) was conducted, and before and after the PCT test, the peeling test was performed for the cross-cut patterns using tape. Thus, the results shown in Table 2 were obtained.

TABLE 2

| Adhesive layer material | PCT test Before | After |
|---|---|---|
| No material | A | D |
| Ti | A | A |
| Cr | B | C |
| Ta | A | C |
| Titanium nitride | A | A |

TABLE 2-continued

| Adhesive layer material | PCT test Before | After |
|---|---|---|
| Tantalum nitride | A | A |
| Chromium nitride | A | A |

Symbols in Table 2 represent the peeling rates: A represents 0%, B represents 1 to 10%, C represents 11 to 50%, and D represents 51% or higher. It is taught that adhesion is reduced for the titanium layer, the tantalum layer and no adhesive layer. Further, it is found that for titanium, titanium nitride, tantalum nitride and chromium nitride, peeling did not occur before or after the PCT test.

Through this test, it was found that titanium, titanium nitride, tantalum nitride and nitride chromium are superior materials for use as adhesive layers located between the second protective layer and the resin adhesive layer. That is, when the first adhesive layer is formed as one of titanium, titanium nitride, tantalum nitride, chromium nitride and tantalum, and the second adhesive layer is formed as one of titanium, titanium nitride, tantalum nitride and chromium nitride, adhesion can be improved, and a very durable liquid discharge head can be provided.

Compounds employed in the above description and the embodiments below are as follows.

For titanium nitride (TiNx), when X of N elements are compounded with one Ti element, the appropriate range is X=0.7 to 1.0, and a more appropriate range is X=0.8 to 1.0. For the experiment, TiNx, wherein X=1.0, was employed.

For tantalum nitride (TaNx), the appropriate range is X=0.8 to 2.0, while an even more appropriate range is X=0.8 to 1.0 or 1.6 to 2.0. In the experiment, TaNx, wherein X=2.0, was employed.

For chromium nitride (CrNx), the appropriate range is X=0.7 to 1.0, and a more appropriate range is X=0.8 to 1.0. For the experiment, CrNx, wherein X=1.0, was employed.

First Embodiment

A liquid discharge head including the structure shown in FIG. 1 was manufactured using the following processes.

Figure 2:
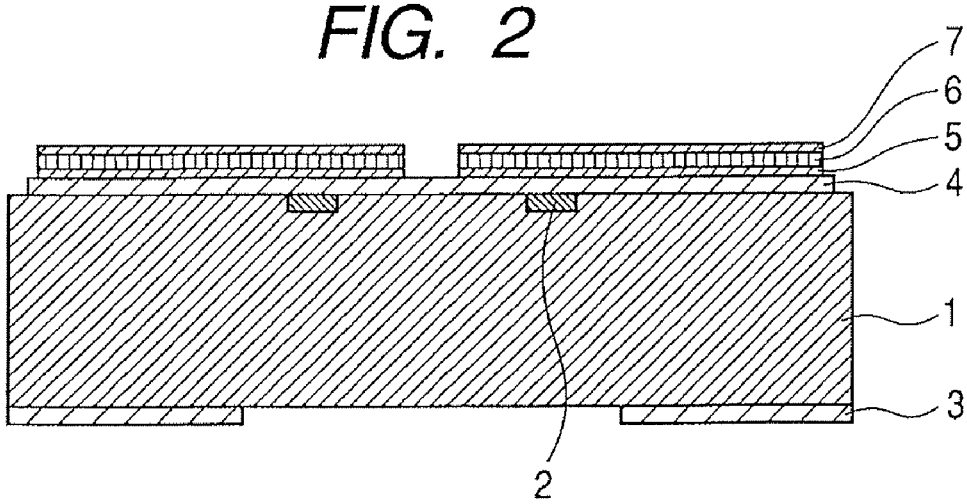
FIG. 2 is a schematic cross-sectional view of a first step in the manufacture of the liquid discharge head shown in FIG. 1.

As shown in FIG. 2, an Si wafer having a crystal lographic axis <100> was employed as a substrate 1, and a mask 3 was formed on the lower face of the substrate 1, leaving a portion that served as an ink supply port 12. Then, on the upper face of the substrate 1, a tantalum nitride layer of about 100 nm, which served as heating resistor layers 2, and control signal input electrodes (not shown) were respectively deposited using sputtering and etching. A silicon nitride layer of 1000 nm was overlaid as a first protective layer 4, using the low temperature plasma CVD method, and as a first adhesive layer 5, a 20 nm titanium layer was deposited on the first protective layer 4 using sputtering. Thereafter, an iridium layer of about 200 nm was formed as a second protective layer 6 using sputtering, and then a 20 nm titanium layer was deposited as a second adhesive layer 7, in the named order.

For silicon nitride (SiNx), the appropriate range is X=0.8 to 1.33, while a more appropriate range is 1.2 to 1.33. For the experiment, SiNx, wherein X=1.33, was employed. And instead of silicon nitride, silicon oxide (SiN2) may also be employed as the first protective layer 4.

Next, a resist pattern was formed on the second adhesive layer 7 using photolithography, and the second adhesive layer 7 the second protective layer 6 and the first adhesive layer 5 were etched to obtain a predetermined pattern. At this time, all these layers could have been etched using Ar sputter etching, or to avoid overetching of the first protective layer 4, Ar sputter etching could have been performed down to the middle of the first adhesive layer 5, following which the reactive etching could have been performed.

Following this, a resist pattern was formed using photolithography, and the silicon nitride layer, which was the first protective layer 4, was patterned using dry etching, by employing a $CF_4$ gas to expose electrode pads of Al electrodes that were reacquired for connection to an external power source. As a result, the essential portion of the liquid discharge head was completed.

An integrated circuit for driving electrothermal transducing elements could have been incorporated in the same Si substrate. In such a case, in order to prevent contact with ink, the integrated circuit portion, as well as wiring, should have been covered by the first protective layer 4, the first adhesive layer 5 and the second protective layer 6.

Sequentially, a polyether amide resin layer of 2.0 μm, which serves as an adhesive resin layer 8, was applied to the substrate 1 by a spinner. At this time, HIMAL1200 (product name), produced by Hitachi Chemical Co., Ltd., was employed as a polyether amide resin, and the resultant substrate was baked at 100° C. for thirty minutes, and then at 250° C. for one hour.

Figure 3:
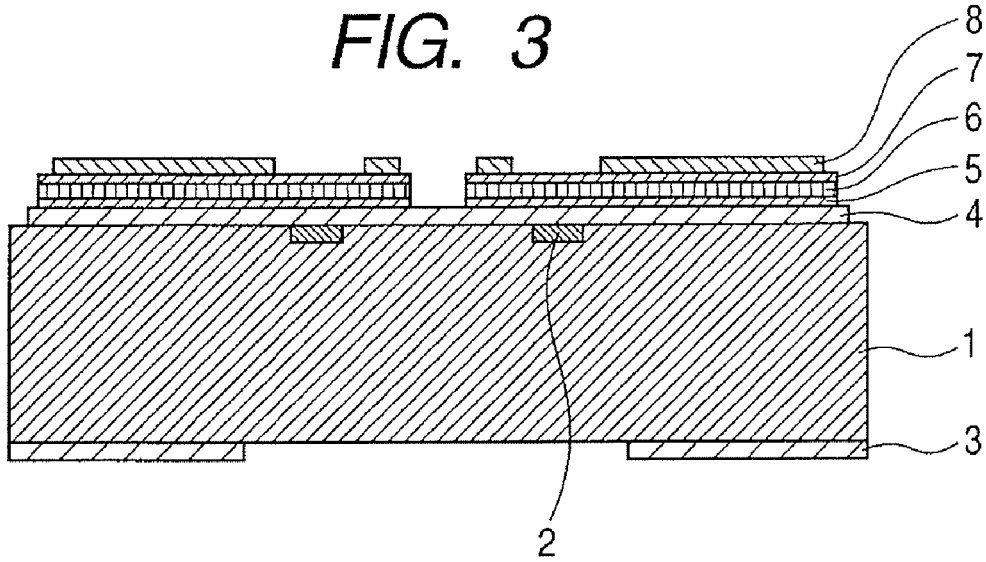
FIG. 3 is a schematic cross-sectional view of a second step in the manufacture of the liquid discharge head shown in FIG. 1.

Then, a predetermined resist pattern formed of OFPR800 (a product name), produced by Tokyo Ohka Kogyo Co., Ltd., was formed on the polyether amide layer, and by using this resist pattern as a mask, etching was performed using oxygen plasma etching. Thereafter, the resist pattern that was used as a mask was peeled off, the polyether amide pattern was patterned and, as shown in FIG. 3, a resin adhesive layer 8 having a predetermined pattern was obtained.

Figure 4:
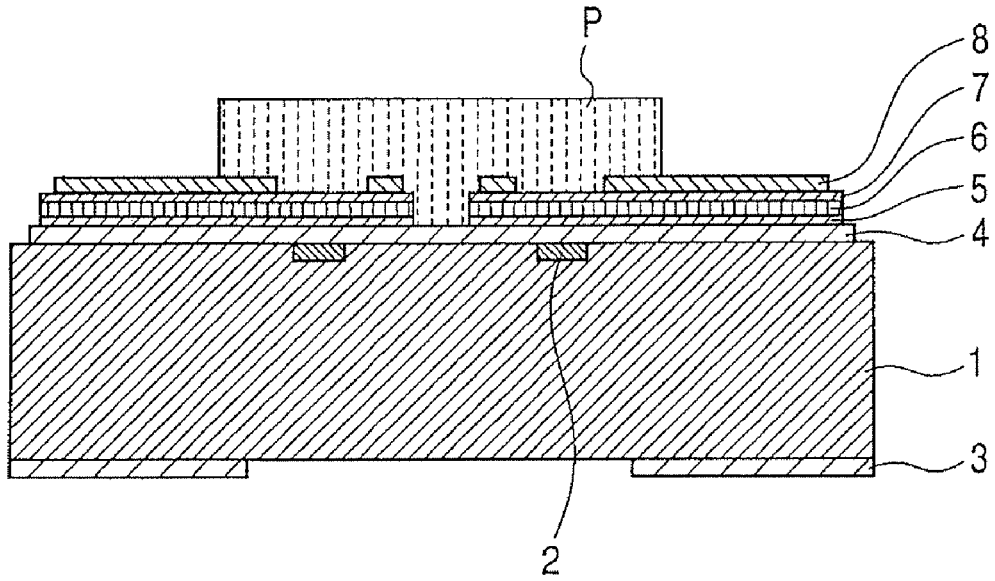
FIG. 4 is a schematic cross-sectional view of a third step in the manufacture of the liquid discharge head shown in FIG. 1.

Next, positive resist ODUR (a product name), produced by Tokyo Ohka Kogyo Co., Ltd., of 12 μm was applied on the substrate, and was patterned to obtain a desired flow path shape. As a result, as shown in FIG. 4, a flow path pattern P was obtained.

Figure 5:
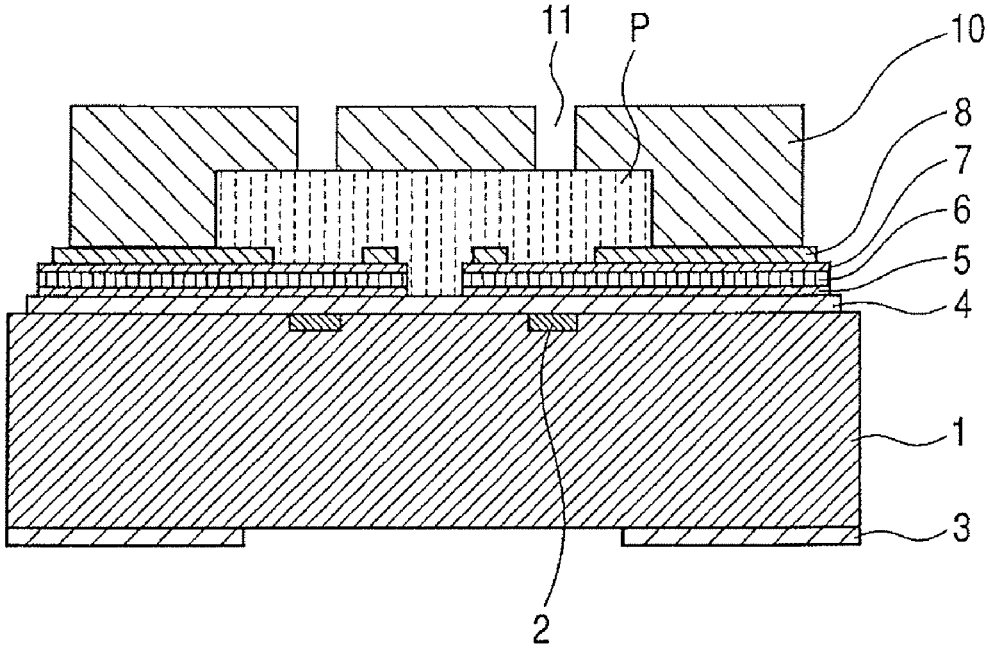
FIG. 5 is a schematic cross-sectional view of a fourth step in the manufacture of the liquid discharge head shown in FIG. 1.
Figure 6:
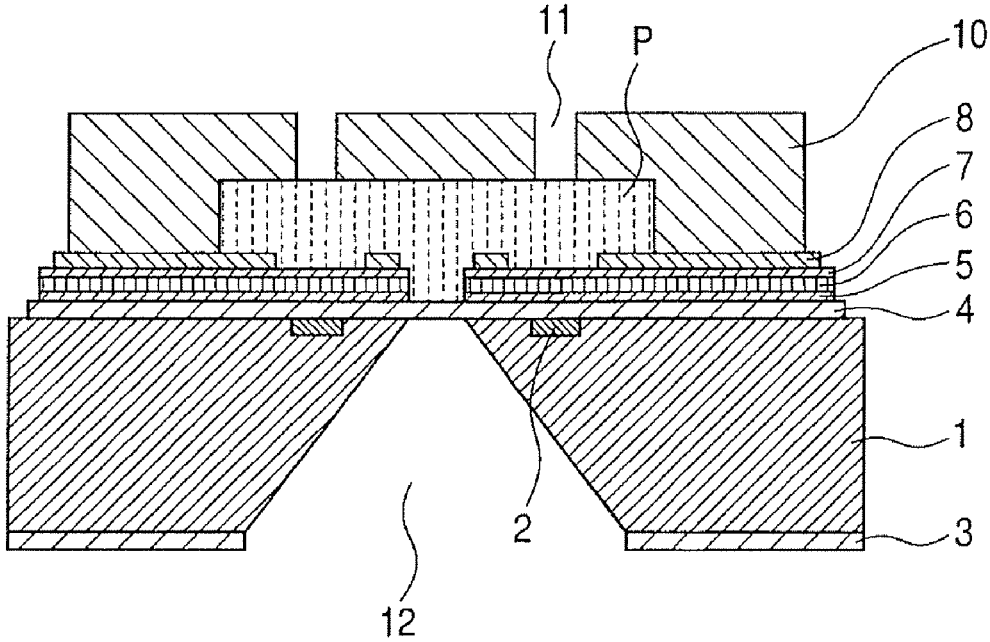
FIG. 6 is a schematic cross-sectional view of a fifth step in the manufacture of the liquid discharge head shown in FIG. 1.
Figure 7:
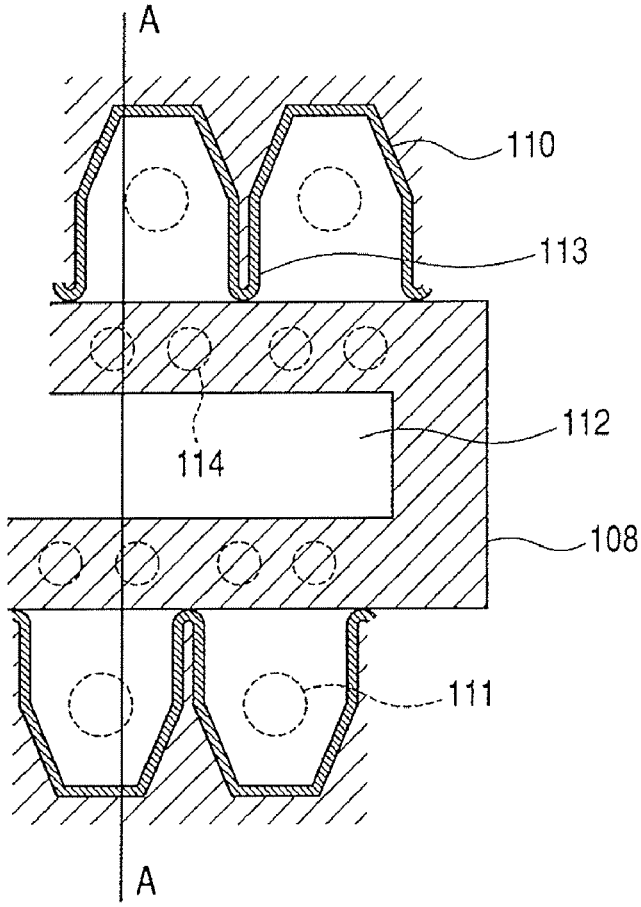
FIG. 7 is a partial plan view of a conventional example.
Figure 8:
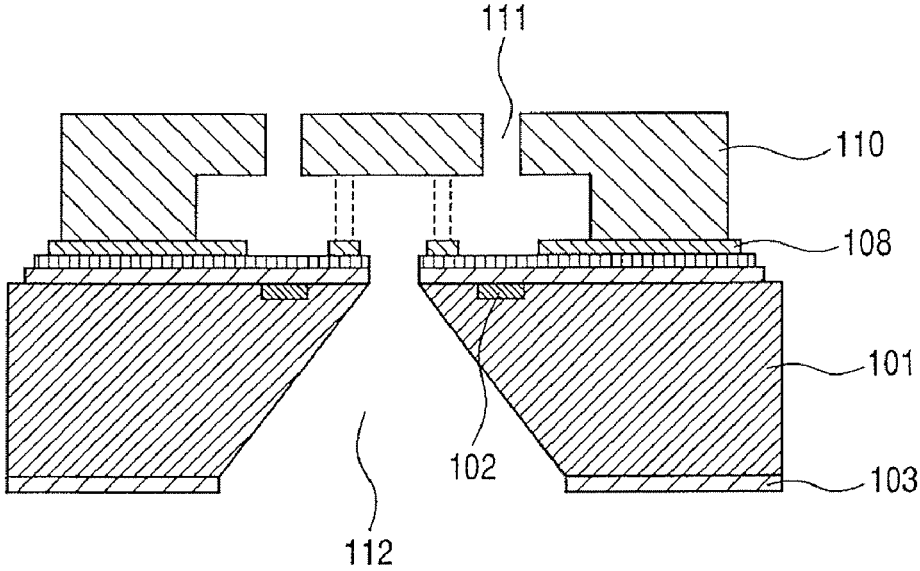
FIG. 8 is a cross-sectional view, taken along line A-A in FIG. 7.

Then, a coated epoxy resin layer was formed to cover the flow path pattern P, and was patterned to open discharge ports 11, so that a flow path formation member 10 was formed as shown in FIG. 5. Thereafter, by performing Si anisotropic etching from the reverse face of the substrate 1, an ink supply port 12 shown in FIG. 6 was opened.

Following this, a portion of the ink supply port 12 was removed from the first protective layer 4, and the flow path pattern P was melted and removed. The individual discharge ports 11 were separated by flow path walls provided by the flow path formation member 10, and at the entrance of each flow path, pillars were arranged at a predetermined interval and were extended perpendicularly, in order to prevent dust from entering the flow path.

Finally, the substrate was heated at 180° C. for one hour, and the epoxy resin layer that serves as the flow path formation member 10 was completely cured. In this manner, the liquid discharge head shown in FIG. 1 was completed.

Second Embodiment

After the second protective layer 6 was deposited on the structure in FIG. 1, the same process as in the first embodiment was performed to obtain a liquid discharge head, except that, as a second adhesive layer 7, a titanium nitride layer of about 20 nm was deposited instead of a titanium layer, by the reactive sputtering of nitride while nitrogen was introduced.

COMPARISON EXAMPLE 1

A liquid discharge head was fabricated in the same manner as in the first embodiment, except for the removal of a second adhesive layer 7.

COMPARISON EXAMPLE 2

First and second adhesive layers 5 and 7 were eliminated, and 200 nm of conventionally employed tantalum was formed as a second protective layer 6.

Ink was provided to fill the liquid discharge heads manufactured for the first and second embodiments and the first and second comparison examples, and the durability and discharge functions were evaluated.

First, to evaluate for durability, the liquid discharge heads were filled with ink consisting of ethylene glycol/urea/isopropyl alcohol/black dye/water=5/3/2/3/87 parts, and a three-month conservation test in a 60° C. environment was conducted. And each month, the statuses of the liquid discharge heads were observed.

For the liquid discharge heads in the first and second embodiments, no changes occurred. That is, for example, peeling did not occur between the substrate and the flow path formation member 10, and interference fringing, caused by partial peeling, did not appear on the adhesive face of the flow path member 10.

On the other hand, for the first comparison example for which the second adhesive layer 7 was not formed, after the elapse of the first month, peeling occurred between the substrate 1 and the flow path formation member 10. In the second comparison example 2, for which the first and second adhesive layers 5 and 7 were not formed and tantalum of 200 nm was deposited as the second protective layer 6, after the elapse of the third month, interference fringing was partially seen between the substrate 1 and the flow path formation member 10.

As a result, it was found that by forming the second adhesive layer, more adhesion could be promoted than in the conventional case.

Further, when the discharge function was evaluated by measuring a discharge enabled voltage and a discharge speed, there was no difference between the first and second embodiments and the first and second comparison examples. Since the discharge enabled voltage varies, depending on whether thermal conduction from the heating resistor layers 2 to the bubbling face is satisfactory, it was thought that thermal conduction might be deteriorated because the second adhesive layer 7 was present; however, actually, it was found that there was no problem. Further, it was confirmed that in accordance with the change in the bubbling condition, the discharge speed was altered, but only within a range wherein the discharge function was not affected.

Further, the liquid discharge heads for the first and second embodiments were disassembled at the initial discharge stage, and the surfaces of the second adhesive layers 7 were analyzed. It was found that titanium was not immediately present on the heating resistor layers 2, but was present on the other portions. Since titanium is not immediately present only on the heating resistor layers 2, it is assumed that the second adhesive layer 7 was melted and discharged while ink was being discharged.

In order to ensure ink discharge, when the ink jet discharge head is initially driven, or is employed after the head has not been used for an extended period of time, a suction and recovery operation is performed to draw in ink, using suction, from outside the discharge ports. Furthermore, a safety process is also performed, i.e., ink is discharged from all the discharge ports continuously for several hundred to several thousand times to maintain stable discharging. It is presumed that since ink is discharged several hundred to several thousand times, the temperature immediately above the heating resistor layers 2 will be raised, and the titanium in the second adhesive layer 7 on this portion will be melted and discharged.

By referring to the results of the PCT test, a metal other than titanium, e.g., tantalum, can also be employed as the first adhesive layer 5. Titanium, titanium nitride, tantalum nitride or chromium nitride can be employed as the second adhesive layer 7. When a different metallic material or metal nitride from the first adhesive layer 5 is employed to form the second adhesive layer 7, another film deposition device or chamber, and another metallic target, must be prepared. Therefore, while taking into account the number of steps and the quality, the same material, or the same simple metallic substance or nitride thereof, should be employed for the first and the second adhesive layers 5 and 7. Above all, as in the first embodiment, titanium should be employed both for the first and second adhesive layers, and as in the second embodiment, either titanium should be employed for the first adhesive layer and titanium nitride for the second adhesive layer, or vice versa.

Additionally, in the above embodiments, iridium has been employed for the second protective layer 6. However, other precious metals, such as Pt (platinum), Os (osmium), Re (rhenium), Ru (ruthenium) or Rh (rhodium), can also be employed.

Moreover, 20 nm has been designated for the thickness of the second adhesive layer 7. However, the thickness of the second adhesive layer 7 for a product should be determined by considering the affect on the discharge, adhesion and durability of ink. The thickness of the first adhesive layer 5 should also be determined by considering the affect on the discharge, adhesion and durability of ink.

The second adhesive layer 7, the second protective layer 6 and the first adhesive layer 5 were etched using the same resist pattern. However, the plane area of the second adhesive layer 7 need only have included the plane area of the flow path formation member 10, and may have had a different pattern from that for the second protective layer 6. The same thing can be applied for the plane areas of the second protective layer 6 and the first adhesive layer 5. That is, so long as the plane area of the first adhesive layer 5 includes the plane area of the second protective layer 6, a different pattern may be employed. However, when etching is performed using the same resist pattern, only a small number of steps is required and the chances of contamination are reduced, so that this method is assumed to be much superior, while taking the cost and the quality into account.

Further, since the second adhesive layer 7 located on the heating portion of the electrothermal transducing elements is melted at the initial driving stage, during the head manufacturing process, dust attached to the second protective layer 6 can be removed, along with the second adhesive layer 7. Thus, stabilization of the discharge function can be expected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-062000, filed Mar. 8, 2006, which is hereby incorporated by reference herein in entirety.

What is claimed is:

1. A liquid discharge head comprising:

a substrate, provided with an energy generating member for generating energy to be used for discharging liquid through a discharge port, and a metal protective layer made of a precious metal for protecting the energy generating member;

an inorganic adhesive layer made of at least one material selected from titanium, titanium nitride, tantalum nitride and chromium nitride, the inorganic adhesive layer being in contact with the metal protective layer;

an organic adhesive layer made of an organic material, the organic adhesive layer being in contact with the inorganic adhesive layer; and a flow path forming member, serving as a wall of a flow path communicating with the discharge port, the flow path forming member being in contact with the organic adhesive layer, wherein the metal protective layer, the inorganic adhesive layer, the organic adhesive layer and the flow path forming member are layered in this order.

2. A liquid discharge head according to claim 1, wherein an insulating protective layer for protecting the energy generating member and an additional adhesive layer made of an inorganic material are located between the energy generating member and the metal protective layer.

3. A liquid discharge head according to claim 2, wherein the additional adhesive layer is made of at least one material selected from titanium, titanium nitride, tantalum nitride, chromium nitride and tantalum.

4. A liquid discharge head according to claim 3, wherein the inorganic adhesive layer and the additional adhesive layer are made of a same material.

5. A liquid discharge head according to claim 4, wherein the inorganic adhesive layer and the additional adhesive layer are made of titanium.

6. A liquid discharge head according to claim 3, wherein one of the inorganic adhesive layer and the additional adhesive layer is made of titanium, and another is made of titanium nitride.

7. A liquid discharge head according to claim 1, wherein the metal protective layer is made of iridium or platinum.

8. A liquid discharge head according to claim 1, wherein the organic adhesive layer is made of polyether amide.

9. A manufacturing method for manufacturing a liquid discharge head according to claim 1, comprising:

a forming step for forming a layer with a material for the inorganic adhesive layer on the metal protective layer; and a driving step for driving the energy generating member to remove only the material for the inorganic adhesive layer deposited right above the energy generating member.

* * * * *